US007643765B2

(12) United States Patent
Miyaji et al.

(10) Patent No.: US 7,643,765 B2
(45) Date of Patent: Jan. 5, 2010

(54) IMAGE FORMING APPARATUS THAT CHARGES THE SURFACE OF A PHOTOSENSITIVE MEMBER TO A PREDETERMINED POTENTIAL

(75) Inventors: Shinki Miyaji, Osaka (JP); Yoshihiko Maruyama, Osaka (JP)

(73) Assignee: Kyocera Mita Corporation (JP)

( * ) Notice: Subject to any disclaimer, the term of this patent is extended or adjusted under 35 U.S.C. 154(b) by 259 days.

(21) Appl. No.: 11/823,787

(22) Filed: Jun. 28, 2007

(65) Prior Publication Data

US 2008/0003004 A1 Jan. 3, 2008

(30) Foreign Application Priority Data

Jun. 29, 2006 (JP) ..... 2006-180193

(51) Int. Cl.
*G03G 15/02* (2006.01)

(52) U.S. Cl. ..... 399/50; 399/176

(58) Field of Classification Search ..... 399/50, 399/174, 176, 168, 24
See application file for complete search history.

(56) References Cited

U.S. PATENT DOCUMENTS 6,122,460 A * 9/2000 Meece et al. ..... 399/176 X
6,314,251 B1 * 11/2001 Gomi et al. ..... 399/50 X
6,324,357 B1 * 11/2001 Gomi et al. ..... 399/50
2005/0271406 A1 * 12/2005 Okano et al. ..... 399/50

FOREIGN PATENT DOCUMENTS

JP 2004-205583 7/2004

* cited by examiner

*Primary Examiner*—Sophia S Chen
(74) *Attorney, Agent, or Firm*—Gerald E Hespos; Anthony J. Casella

(57) ABSTRACT

An image forming apparatus charges the surface of a photosensitive member to a predetermined potential. A current detector detects a charging current when the charging bias is applied. A storage stores a target charging current value when the photosensitive member is charged to a required potential. A usage acquiring portion acquires information relating to usage of the charging roller. A bias corrector performs first and second corrections. The first correction compares a charging current value with a stored target charging current value and determines a new charging bias based on the comparison. The second correction determines whether usage of the charging roller is a predetermined first amount or a greater amount based on acquired usage information, and when the usage is the greater amount, changes the target charging current value in accordance with the usage amount and obtains a new charging bias based on the changed target charging current value.

6 Claims, 5 Drawing Sheets

IMAGE FORMING APPARATUS THAT CHARGES THE SURFACE OF A PHOTOSENSITIVE MEMBER TO A PREDETERMINED POTENTIAL

BACKGROUND OF THE INVENTION

1. Field of the Invention

The present invention relates to an image forming apparatus that has a function which charges a photosensitive member surface using a charging roller. More particularly, the present invention relates to an image forming apparatus in which correction of a charging bias is possible.

2. Description of the Related Art

In recent years, a charging roller system that has a characteristic of suppressing ozone generation has been widely adopted as a charging mechanism of image forming apparatuses that use an electrophotographic method. For this charging roller, since a resistance value changes depending on the environment or life, a method has been proposed that determines an output bias based on a result obtained by detecting the charging current in order to apply the optimal bias in accordance with the change in resistance of the charging roller.

However, there is a problem that it is extremely difficult to accurately detect the charging current. The reason is that since, in particular, a current (charging current) in a charging roller in which the resistance value has increased changes accompanying the passage of time immediately after application of a bias (charging bias), the detection result will be different depending on the timing at which the current is detected. In the worst case an appropriate bias can not be output.

To solve this problem, for example, Japanese Patent Laid-Open No. 2004-205583 discloses a method which repeats detection of a current flowing in a charging member a plurality of times when applying a bias, and then starts an image forming operation when the variation amount from the time of the previous detection is lower than a certain threshold value. However, according to this method there is a problem that, in a case in which the resistance value of the charging roller increases to a large degree, time is required until the aforementioned variation amount becomes less than the threshold value, i.e. until the resistance value is stable, and thus the time until an image forming operation starts (so-called "aging time") is extremely long. In contrast, in the latter half of the life of a charging roller, the relation between the charging current and the surface potential of the photosensitive drum changes from the relation in the first half of the life of the charging roller, and there is a problem that the bias cannot be properly corrected. This phenomenon can be explained as followed. That is, since the resistance value of a charging roller gradually increases together with the usage amount (life) thereof, it is necessary to increase the applied bias in accordance therewith. However, as the usage proceeds and the latter half of the life of the charging roller is entered, the bias value becomes a large value that exceeds a certain value and leakage current to the photosensitive drum starts to occur (however, this does not occur to a degree that imparts a physical defect to the photosensitive drum). If this situation occurs, even if the charging current flows well, the surface potential of the photosensitive drum itself does not rise very much. Therefore, even if the charging current is detected to perform bias correction, the required surface potential can not be obtained.

SUMMARY OF THE INVENTION

An object of the present invention is to provide an image forming apparatus that can output the appropriate charging bias even when the resistance value or the like of a charging roller changes.

According to one aspect of the present invention there is provided an image forming apparatus that charges a surface of a photosensitive member to a predetermined potential using a charging roller, comprising: a bias applying portion that applies a charging bias to the charging roller; a current detecting portion that detects a charging current when the charging bias is applied; a bias correcting portion that carries out correction of the charging bias; a target information storing portion that stores a target charging current value that is taken as a target, that is a charging current value when the surface of the photosensitive member is charged to a required surface potential; and a usage amount information acquiring portion that acquires usage amount information relating to a usage amount of the charging roller; wherein, the bias correcting portion performs a first bias correction operation and a second bias correction operation, in which, the first bias correction operation is an operation that compares a charging current value that is detected by the current detecting portion when a predetermined charging bias is applied by the bias applying portion with a target charging current value that is stored in the target information storing portion, and determines a new charging bias by correcting the predetermined charging bias on the basis of the comparison result.

The second bias correction operation is an operation that determines whether a usage amount of the charging roller is a predetermined first usage amount or a second usage amount that is greater than the first usage amount on the basis of usage amount information that is acquired by the usage amount information acquiring portion, and when the usage amount is determined to be the second usage amount, changes the target charging current value in accordance with the usage amount of the charging roller and obtains a new charging bias by correcting the corrected charging bias that is obtained as a result of the first bias correction operation on the basis of the target charging current value that is changed.

DETAILED DESCRIPTION OF THE PREFERRED EMBODIMENTS

Figure 1:
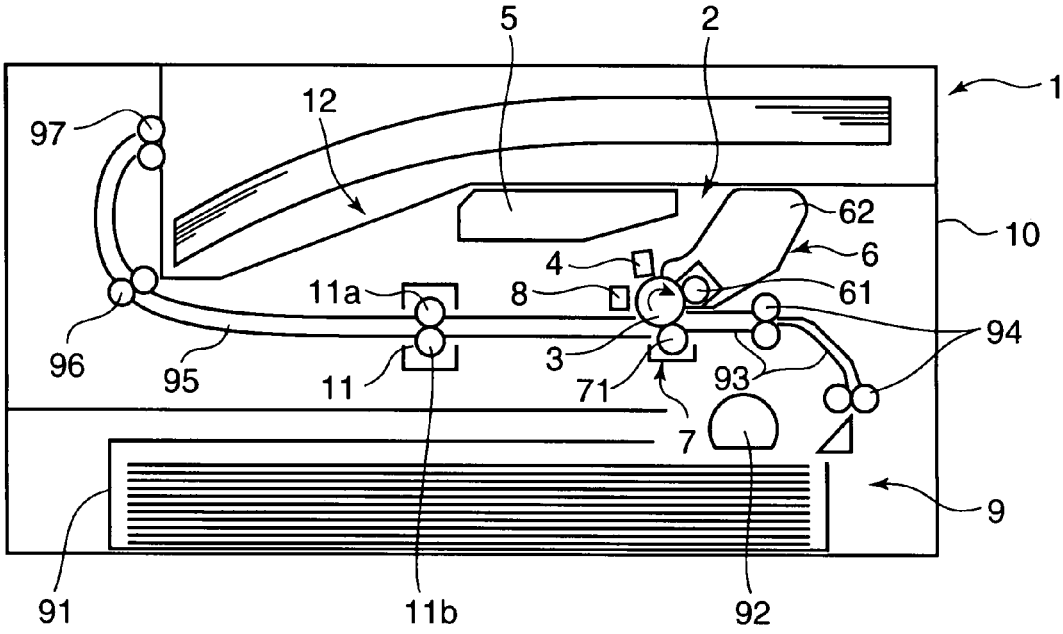
FIG. 1 is a sectional view that schematically shows the internal configuration of an image forming apparatus (printer) according to an embodiment of the present invention.

FIG. 1 is a sectional view that schematically shows the internal configuration of an image forming apparatus according to an embodiment of the present invention. The image forming apparatus according to the present invention is a multifunction device, a printer, a facsimile machine or the like that develops an electrostatic latent image using toner by an electrophotographic method. In the present embodiment, a printer 1 is described as an example of the image forming apparatus. In the printer 1, an image forming portion 2 is provided inside a printer main unit 10. As shown in FIG. 1, the image forming portion 2 performs image formation on a sheet, and includes a photosensitive drum 3, and a charging portion 4, an exposing portion 5, a developing portion 6, a transferring portion 7, and a cleaning portion 8 that are disposed around the photosensitive drum 3.

Figure 2:
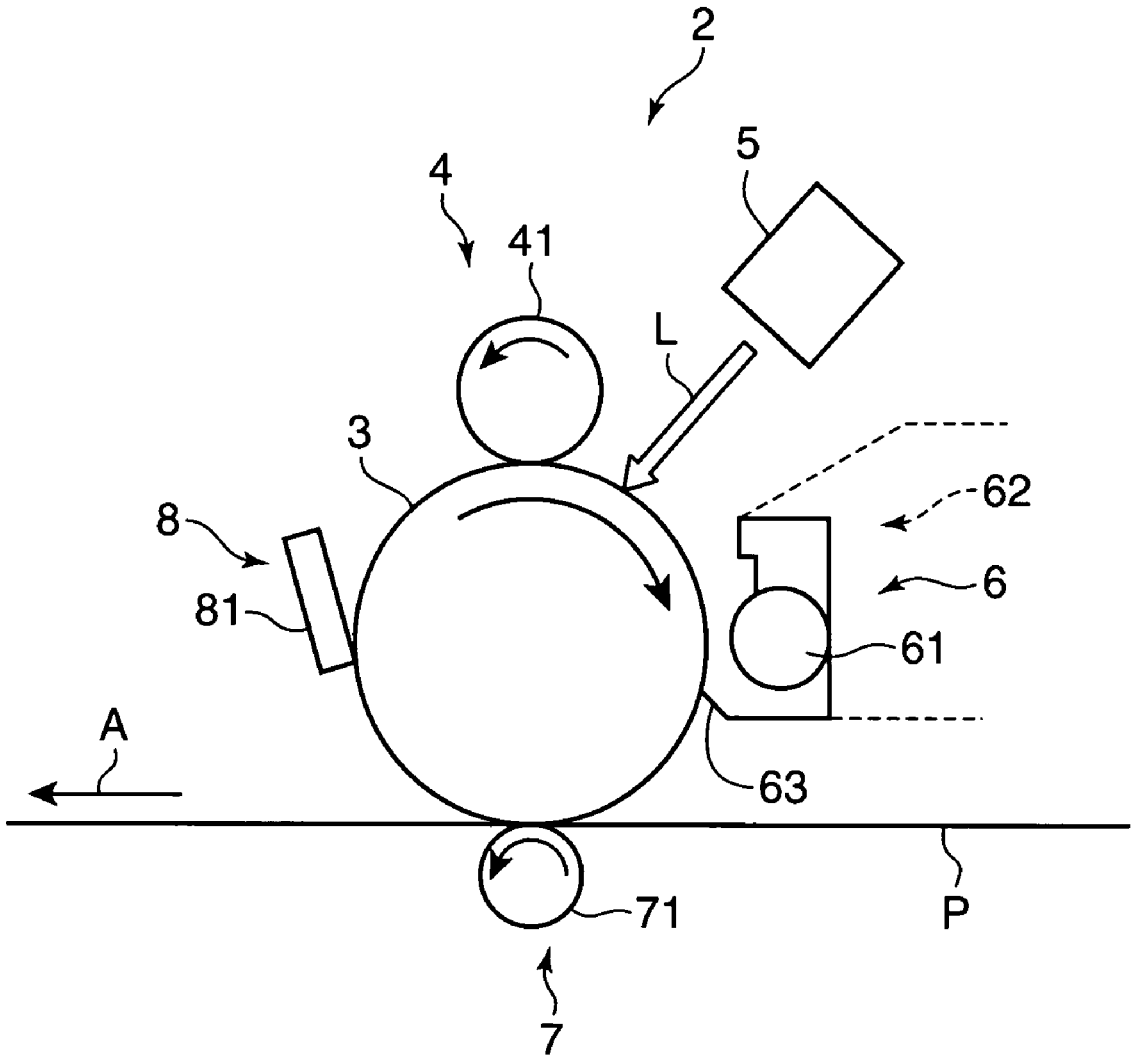
FIG. 2 is a partial enlarged view that schematically shows an image forming portion of the printer shown in FIG. 1.

FIG. 2 is a partial enlarged view that schematically shows the image forming portion 2. The photosensitive drum 3 is an image bearing member that is supported such that it can rotate in the direction indicated by the arrow in the figure. In this case, a photosensitive drum comprising amorphous silicon (a-Si) is used. This a-Si drum is obtained by forming a film of amorphous silicon on the surface of a predetermined drum-shaped member (cylindrical member) by deposition, for example. The amorphous silicon film has a characteristic that the degree of hardness on the film surface is extremely high, and thus the durability (environmental resistance) of the photosensitive member is high. In this case, a member with a drum diameter of approximately 30 mm and which rotates at a speed (linear speed; rotational circumferential speed) of approximately 310 mm/sec is employed as the photosensitive drum 3.

The charging portion 4 uniformly charges the surface of the photosensitive drum 3 (drum surface) to a predetermined potential, for example, approximately +250V. The charging portion 4 includes a charging roller 41 that is disposed facing the photosensitive drum 3, and performs charging in a state in which the charging roller 41 is pressed against the photosensitive drum 3. The charging roller 41 is, for example, a member on which a resilient layer comprising an ion conductive material (a material having semiconductor properties) such as epichlorohydrin rubber is formed on a predetermined core metal so that the diameter of the roller is about 12 mm, for example. The surface roughness Rz of the epichlorohydrin rubber is taken to be, for example, approximately 10 μm.

Normally, since an ion conductive material is used as described above in the charging roller 41, the resistance value thereof varies according to the environment (temperature and humidity) as well as the life (elapsed time) of the charging roller 41. In particular, as usage of the charging roller 41 proceeds (total usage time becomes long), the resistance value thereof also becomes high, and when the charging roller 41 enters the latter half of its life, it reaches a point at which a situation occurs in which even when a predetermined charging current is flowed, the surface potential does not increase to a surface potential level that should be obtained in response to the predetermined charging current. Consequently, in the latter half of the life of the charging roller 41, even if a charging current is detected and bias correction is performed based on the charging current it is no longer possible to charge the drum surface to the required surface potential. Therefore, according to the present embodiment a configuration is adopted that corrects a charging bias (Vdc) so that a required surface potential can be obtained by taking into variations in the resistance value of the charging roller 41 and the problem when usage of the charging roller 41 has proceeded (in the latter half of the life of the charging roller 41). This correction of the charging bias is described in detail later.

The exposing portion 5 is a so-called "laser scanner unit" that exposes the photosensitive drum 3 with a laser beam. The exposing portion 5 forms an electrostatic latent image on the drum surface by irradiating a laser beam L that is output from a laser diode on the basis of image data that is sent from a image data storing portion 40, described later, or the like onto the drum surface. In this connection, the exposing portion 5 shown in FIG. 2 is a simplified illustration of the exposing portion 5 shown in FIG. 1.

The developing portion 6 is a member that causes toner to adhere to the electrostatic latent image formed on the drum surface to visualize an image. The developing portion 6 includes a developing roller 61 that is disposed facing the photosensitive drum 3 in a non-contacting condition, a toner containing portion 62 that contains toner, and a regulating blade 63 (ear cutting plate) and the like. The regulating blade 63 regulates so that a toner amount that is supplied from the toner containing portion 62 to the developing roller 61 is the appropriate amount. More specifically, the regulating blade 63 cuts off the "ears" of toner, i.e. regulates the thickness of the toner, that is adhered in a so-called "ear-up state" (state of the magnetic brush) on the surface of a sleeve (omitted from the drawings) of the developing roller 61 to uniformly adjust the adherence amount. A thin layer of toner having substantially the same thickness is thus formed on the sleeve by this adjustment of the adherence amount.

The transferring portion 7 transfers a toner image onto a sheet. More specifically, the transferring portion 7 includes a transfer roller 71 that is disposed facing the photosensitive drum 3, and transfers a toner image that is visualized on the drum surface onto a sheet P (transfer material) that is conveyed in the arrow direction indicated by the reference character A in a state in which the sheet P is pressed against the photosensitive drum 3 by the transfer roller 71.

The cleaning portion 8 includes a cleaning blade 81 and the like, and cleans toner (transfer residual toner) that remains on the drum surface after transfer by the above described transferring portion 7 is completed. The cleaning blade 81 is configured such that, for example, an end thereof is pressed into contact with the drum surface to thereby mechanically remove residual toner on the drum surface. In this connection, a charge eliminating portion (erasing light source) (omitted from the figures) that eliminates a charge, that is, eliminates a residual potential (charge), on the photosensitive member surface using a charge eliminating light beam may also be provided in the cleaning portion 8 or the like.

The printer 1 also includes a feeding portion 9 that feeds paper in the direction of the image forming portion 2 (photosensitive drum 3) and a fixing portion 11 that fixes toner image that is transferred onto a sheet. The feeding portion 9 includes a sheet cassette 91 that stores paper of each size, a pick-up roller 92 for taking out the stored paper, a conveying path 93 that is a path on which a sheet is conveyed, and conveying rollers 94 that perform conveying of a sheet in the conveying path 93 and the like. The feeding portion 9 conveys sheets that are sent forward one at a time from the sheet cassette 91 towards a nip portion between the transfer roller 71 and the photosensitive drum 3. The feeding portion 9 conveys a sheet onto which a toner image is transferred (the aforementioned sheet P) to the fixing portion 11 via the conveying path 95, and also conveys a sheet that undergoes fixing processing at the fixing portion 11 as far as a sheet discharge tray 12 that is provided at the top portion of the printer main unit 10 using conveying rollers 96 and discharge rollers 97.

The fixing portion 11 comprises a heat roller 11*a* and a pressure roller 11*b*. The fixing portion 11 melts toner on a sheet using heat of the heat roller 11*a* to fix a toner image onto the sheet by applying pressure using the pressure roller 11*b*.

Figure 3:
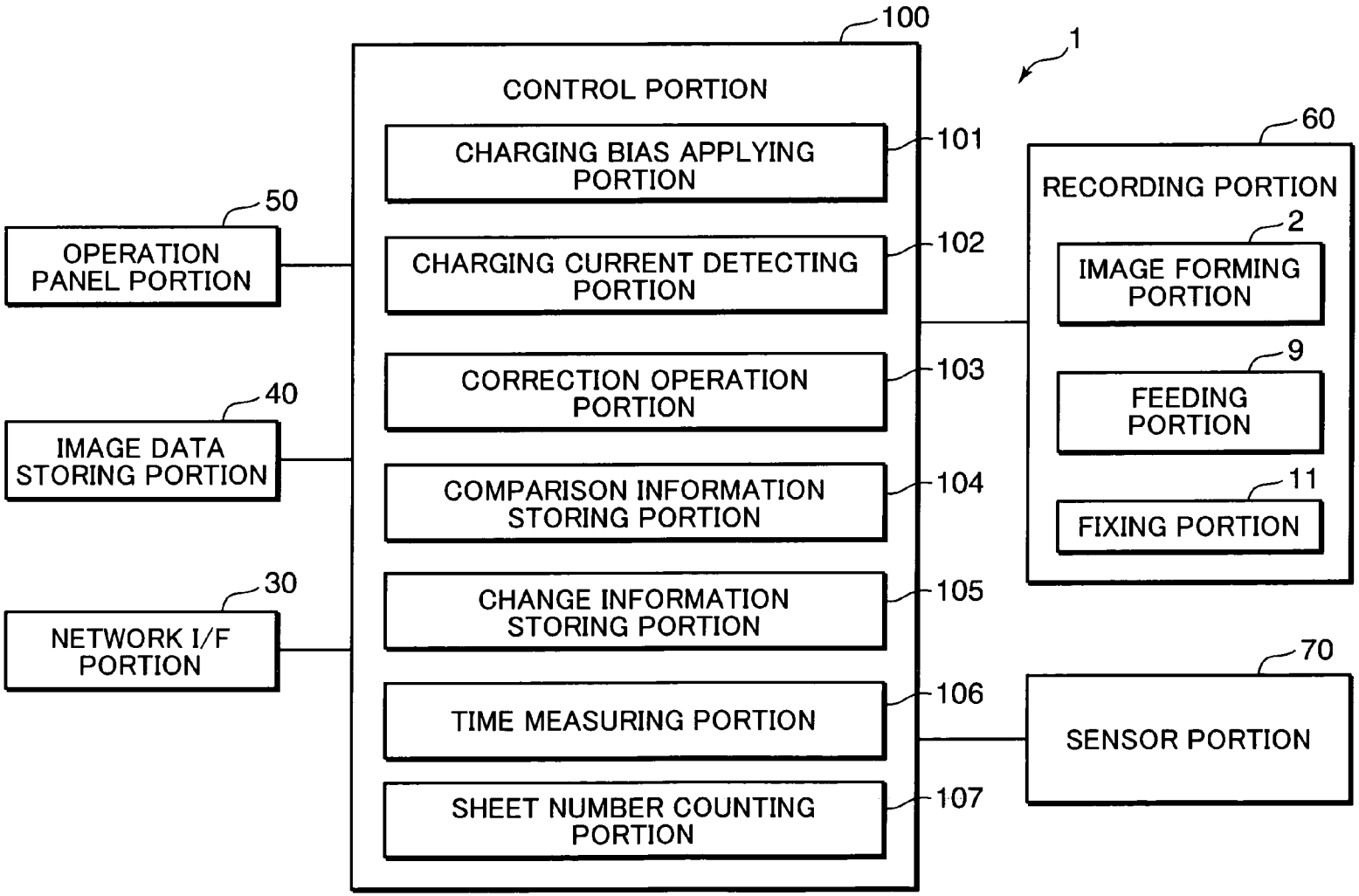
FIG. 3 is a block diagram showing one example of the electrical configuration of the printer shown in FIG. 1.

FIG. 3 is a block diagram showing one example of the electrical configuration of the printer 1. As shown in the figure, the printer 1 includes a network I/F (interface) portion 30, an image data storing portion 40, an operation panel portion 50, a recording portion 60, a sensor portion 70, a control portion 100 and the like. The network I/F portion 30 controls sending and receiving of various kinds of data between the printer 1 and an information processing apparatus (external apparatus) such as a PC that is connected through a network such as a LAN. The image data storing portion 40 temporarily stores image data that is sent from a PC or the like through the network I/F portion 30. The operation panel portion 50 is provided at the front portion or the like of the printer 1, and is a part that functions as entry keys through which various kinds of instruction information (commands) from a user is input, or display predetermined information. The recording portion 60 comprises the image forming portion 2, the feeding portion 9 and the fixing portion 11 as described above, and performs recording (printing) of image information onto a sheet based on image data that is stored in the image data storing portion 40 or the like. The sensor portion 70 comprises various sensors that are provided at various positions in the printer 1, and detects various operations or the state of the printer 1.

The control portion 100 comprises a ROM (Read Only Memory) that stores control programs and the like of the printer 1, a RAM (Random Access Memory) that temporarily holds data, and a microcomputer that reads out and executes the aforementioned control programs and the like from the ROM. The control portion 100 performs control of the apparatus overall in accordance with predetermined instruction information that is input at the operation panel portion 50 and the like or detection signals from the various sensors (the aforementioned sensor portion 70) provided at respective positions in the printer 1. The control portion 100 includes a charging bias applying portion 101, a charging current detecting portion 102, a correction operation portion 103, a comparison information storing portion 104, a change information storing portion 105, a time measuring portion 106, and a sheet number counting portion 107.

The charging bias applying portion 101 is a portion that applies a charging bias Vdc (performs charging bias application control) to the charging roller 41. The symbol Vdc indicates the direct current (DC) component of a charge voltage. The charging bias Vdc may be only the DC component or may be a value obtained by superimposing an alternating current (AC) component thereon. However, the charge potential itself of the drum surface is determined by the bias Vdc of the direct current component (DC bias).

The charging current detecting portion 102 detects a charging current (DC current) Idc when a charging bias Vdc is applied to the charging roller 41 by the charging bias applying portion 101. This charging current Idc may be detected on the charging roller 41 side, more specifically, for example, a charging current flowing in the charging roller 41 may be detected, or may be detected on the photosensitive drum 3 side, more specifically, for example, a charging current that flows to the drum surface from the charging roller 41 may be detected. In this connection, the reasons for detecting the charging current without directly detecting the surface potential of the photosensitive drum 3 in this manner is that means that measures the surface potential generally results in increased costs and, furthermore, space is required to dispose means that measures the surface potential and the size of the apparatus is consequently increased. Detecting the charging current without directly detecting the surface potential of the photosensitive drum 3 makes it possible to avoid this kind of increase in costs and increase in size.

The correction operation portion 103 performs correcting operations (bias correction processing) that correct the charging bias Vdc. The correction operation portion 103 performs a first bias correction operation and a second bias correction operation as described below.

<First Bias Correction Operation>

As a first bias correction operation the correction operation portion 103 uses information relating to a charging current Idc that is detected by the charging current detecting portion 102 when a charging bias as an initial setting is applied to the charging roller 41 by the charging bias applying portion 101, and a target current Idc(T) that is described later to perform an operation to compare the charging current Idc and the target current Idc(T). Subsequently, the correction operation portion 103 calculates a new charging bias, that is, a corrected charging bias in which the charging bias is corrected, by adding (on) a bias correction value that is obtained by multiplying a difference between the current value (current value Idc) of the charging current Idc and the current value (current value Idc(T)) of the target current Idc(T) by a correction coefficient k (the correction coefficient "k" is described later) to the charging bias Vdc of the aforementioned initial setting. The correction operation portion 103 outputs the information of the corrected charging bias to the charging bias applying portion 101.

Although according to the present embodiment a configuration is adopted, as shown in a flowchart described later, in which the correction operation portion 103 repeats the above described operation once only, the operation may be repeated a plurality of time (the greater the number of repetitions, the higher the correction accuracy). However, since the time until the start of an image forming operation will be long if the number of repetitions is excessively large, when repeating the operation a plurality of times it is desirable to set the number of repetitions to a predetermined appropriate number, for example, about two or three repetitions. This number of repetitions may be a number that is set as a predetermined value (fixed value) or, for example, may be a number that is decided so that the repetition operation finishes when the level of change caused by correction of the charging bias (for example, the difference between the charging bias before correction and after correction) reaches a predetermined level (in this case also, a predetermined level is set such that the repetition operation finishes at a number at which the number of repetitions does not become large).

A second operation with respect to the above described first operation will now be specifically described for a case in which this kind of operation is repeated a plurality of times. In this case, the correction operation portion 103 detects a charging current Idc that is detected by the charging current detecting portion 102 when the corrected charging bias that is obtained by the first operation is applied to the charging roller 41 by the charging bias applying portion 101 and, similarly to the case described above, adds a bias correction value that is obtained by multiplying a difference between the detected charging current Idc and the target current Idc(T) by the correction coefficient k to the corrected charging bias to calculate a new charging bias (information regarding this corrected charging bias is likewise also output to the charging bias applying portion 101). Thus, the correction operation portion 103 performs an operation that repeats a required number of times the routine of determining a correction value (bias correction value) based on a charging current value (Idc) and a comparison value (Idc(T)), setting a new charging bias by correcting the charging bias using this correction value, and outputting the charging bias to the charging bias applying portion 101.

It can be said that the relevant repetition operation is an operation that determines an $n^{th}+1$ charging bias by adding an $n^{th}$ bias correction value that is calculated by the following formula (1) to an $n^{th}$ charging bias.

$$(Idc(T)-Idc(n))*k \quad (1)$$

Wherein, the symbol "*" represents multiplication (the same applies hereafter), "n" represents the $n^{th}$ time of a number of repetitions (n is a natural number), and Idc(n) represents the $n^{th}$ charging current. The symbol "k" is the above described correction coefficient.

In this connection, the information of the charging bias as the initial setting described above is stored, for example, in the correction operation portion 103 or the charging bias applying portion 101. Further, the information of the correction coefficient k described above is stored, for example, in the correction operation portion 103. Furthermore, although in the above description a bias correction value is "added" to the charging bias to obtain a new charging bias, the meaning of "subtraction" (i.e. addition of a negative value) is also included in the term "added". In actuality, since the charging bias decreases, the bias correction value is raised to correct the decreased amount. Furthermore, the bias correction value may be determined on the basis of a formula other than formula (1), and may be determined by data conversion using a predetermined conversion table. A calculation method that corrects a charging bias using the relevant bias correction value may also be a method other than the above described addition or subtraction (for example, multiplication or division).

<Second Bias Correction Operation>

As a second bias correction operation, when the usage amount of the charging roller 41 is greater than or equal to a certain value, the correction operation portion 103 corrects the target current Idc(T) used in the above described first bias correction operation, and corrects (re-corrects) the charging bias using the corrected target current (referred to as "Idcα(T)").

Figure 5:
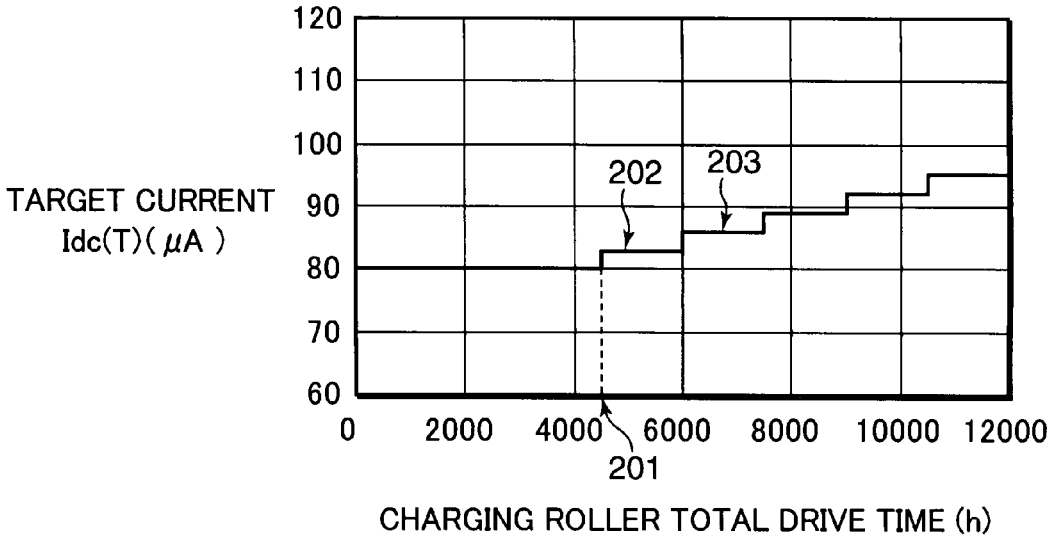
FIG. 5 is a graph diagram showing an example of change information (conversion characteristics) that has a relation between the total drive time of a charging roller and a target current Idc(T).

FIG. 5 is a graph that shows change information used when changing the current target current Idc(T) to the new target current Idcα(T) in accordance with the usage amount of the charging roller 41. This change information includes the correlation between the total drive time of the charging roller 41 (hereafter, the total drive time of the charging roller 41 is referred to as simply "total drive time") and the target current Idc(T) (corresponds to the target current Idcα(T)). More specifically, for example, this change information is information represented by a conversion characteristics graph in which the vertical axis is the target current Idc(T) (μA) and the horizontal axis is the total drive time (h: hours). In this conversion characteristics graph the target current Idc(T) increases in a so-called stepwise (staircase pattern) manner with respect to the total drive time. In this case, the total drive time is used as an indicator (parameter) that shows the usage amount of the charging roller 41. Further, the information regarding the total drive time is usage amount information that relates to the usage amount of the charging roller 41.

Based on the above described change information, the correction operation portion 103 determines whether the usage amount of the charging roller 41 is a first usage amount or is a second usage amount that is greater than the first usage amount. More specifically, the correction operation portion 103 determines whether or not the total drive time is, for example, greater than or equal to the time (for example, 4500 h) indicated by reference numeral 201 in the figure. The time indicated by reference numeral 201 is expressed as "threshold value time" with the meaning of it being a total drive time that is the threshold value for deciding whether or not to update the target current Idc(T) to the target current Idcα(T). Further, the range of the total drive time that is less than the threshold value time (in FIG. 5, the range from 0 h up to (less than) 4500 h that is shown by reference numeral 201) is the aforementioned first usage amount, and the range of the total drive time that is greater than or equal to the threshold value time (range greater than or equal to 4500 h) is the aforementioned second usage amount. This threshold value time can be referred to as information that acts as a so-called "trigger" for changing (correcting) the target current Idc(T).

When the correction operation portion 103 determines that the total drive time is a time (second usage amount) that is greater than or equal to the above described threshold value time, it changes the value of the current target current Idc(T) to a charging current value corresponding to the total drive time to set a new target current Idcα(T). This changing of the target current Idc(T) in accordance with the total drive time is performed, more specifically, when the total drive time is greater than or equal to the threshold value time, for example, 5000 h (greater than or equal to the threshold value time and less than, for example, 6000 h), by changing the current target current value of, for example, 80 μA to the target current value of the level indicated by reference numeral 202. Furthermore, if the total drive time value is, for example, 7000 h (for example, greater than or equal to 6000 h and less than 7500 h), the correction operation portion 103 changes the target current Idc(T) to a target current value of a level indicated by reference numeral 203 that is higher than the level indicated by reference numeral 202. Thereafter, the target current value is changed in accordance with the total drive time in a similar manner.

In the example shown in FIG. 5, although the threshold value time is set at the position of 4500 h, it may be set to a time other than this. This threshold value time is set to a value that is favorable for changing the target current Idc(T) (correcting the charging bias). In other words, an appropriate value that is made to correspond to the life of the charging roller 41 is determined for the threshold value time. That is, an appropriate value is decided as a decision boundary on the basis that, since deterioration of the charging roller 41 does not advance in the range of the first usage amount (former half of the life of the charging roller 41) it is not necessary to change the target current Idc(T) in that range, while in contrast, since deterioration of the charging roller 41 advances in the range of the second usage amount (latter half of the life of the charging roller 41) it is necessary to change the target current Idc(T) in that range. Further, although a configuration is adopted such that when the total drive time reaches 4500 h or more, that is, at the time point when the total drive time reaches 4500 h the level of the target current value immediately changes to the level indicated by the reference numeral 202, a configuration may also be adopted such that the level of the target current value does not immediately change eve when it is determined that the total drive time is 4500 h or more, for example, a configuration in which the current target current value of 80 μA is maintained until 5000 h.

The present invention is not limited to the above described example, and the number of the kinds of levels to which the target current value is changed, i.e. the number of steps in the conversion characteristics graph, may be more than or less than the number of steps shown in FIG. 5. Further, a configuration may be adopted in which the range of increase or the rate of increase in the target current value for the relevant change is fixed, as shown in FIG. 5, or is not fixed, for example, the range of increase in the target current value may increase together with an increase in the total drive time value. Furthermore, regarding the increase in the target current value, the target current value may be increased digitally (stepwise) as shown in FIG. 5 or may be increased in an analog manner (linearly). That is, various kinds of change information (conversion characteristics graphs) can be employed as long as it is possible to change the target current Idc(T) in accordance with the total drive time.

In this connection, with respect to changing the above described target current Idc(T), the reason for making the target current Idc(T) increase in accordance with the total drive time is that, as the actual phenomenon, when usage of the charging roller 41 proceeds and the charging roller 41 enters the latter half of its life, a charging current value corresponding to a charging bias of a certain size becomes a value that is larger than a value estimated based on the relation between the charging bias and the charging current up to that point. In other words, the reason is that a charging current value that has been set to approach the value of a target current Idc(T) set as a target up to that time produces a charging bias value that is lower than a charging bias value that should be obtained in correspondence with the charging current value (target current value).

Next, the correction operation portion 103 re-corrects the charging bias based on the target current Idcα(T) that was changed as described above. This re-correction of the charging bias is performed, for example, by determining a new charging bias by calculating a further bias correction value based on formula (2) below that conforms to a formula in which the first item "Idc(T)" in the above formula (1) is replaced with "Idcα(T)", and adding this bias correction value to a corrected charging bias after the above described first bias correction operation.

$$(Idc\alpha(T)-Idc(m))*k \quad (2)$$

Wherein, Idc(m) represents a charging current value that is detected when a corrected charging bias Vdc that is obtained after performing the $m^{th}$ repetition operation in the first bias correction operation is applied. According to the present embodiment, Idc(m) is a charging current value (Idc(B) that is described later) that is detected at a time of application using a charging bias (Vdc(B) that is described later) obtained in a case in which a repetition operation is executed only one time (m=1) (only the first repetition operation is executed).

The comparison information storing portion 104 stores information (a comparison value) that is compared with a charging current obtained when a charging bias is applied. This comparison information is information regarding the target current Idc(T) as a so-called "target value" at a time when a normal surface potential (the above mentioned +250 V) is on the drum surface, i.e. when the drum surface is charged to a required surface potential, that is previously determined by measuring or the like. Strictly speaking, since the charging current—charging voltage characteristics (I-V characteristics) of a photosensitive member differ for each photosensitive drum, it is desirable to store the target current Idc(T) that is measured, respectively, for the photosensitive drum of each printer when manufacturing the machine. Further, in fact, not only is the information of the target current Idc(T) stored, but information of a voltage value for charging to a normal surface potential (the above mentioned +250 V) is also stored together with the target current Idc(T).

The change information storing portion 105 stores change information (conversion characteristics) as shown in the above described FIG. 5. The information that is stored in the change information storing portion 105 is read out as appropriate in the second bias correction operation by the correction operation portion 103 and used.

The time measuring portion 106 measures the total drive time of the charging roller 41 using an internal clock or the like. The total drive time is the current overall drive time that is obtained by summing up using a so-called "software method" the drive time of the charging roller 41 from the time that usage of the charging roller 41 started. The term "drive time of the charging roller 41" in this case refers to the time that the charging portion 4 or a, for example, drum unit (unit comprising the photosensitive drum 3, the charging portion 4 and the cleaning portion 8 and the like; not illustrated in the drawings) including the charging portion 4 is on, i.e. is energized (this time may also be made equal to the time that the power of the printer 1 is on).

In a case in which the charging roller 41 is, for example, replaced with a new charging roller during the life of the charging roller 41 (in practice, a case in which the current drum unit including the charging roller 41 is replaced with a new drum unit), the time measuring portion 106 resets the total drive time (and a total bias application time that is described later) to an initial value, for example, zero hours. However, with respect to determining whether or not the charging roller 41 or the drum unit has been replaced with a new charging roller or drum unit, for example, a configuration may be adopted in which detection is performed by a predetermined sensor (referred to as "replacement detection sensor") that is provided in the drum unit and/or at a drum unit installation location of the printer main unit 10, and determination is then performed by the control portion 100 or the correction operation portion 103 based on detection information that is detected by this sensor. The time measuring portion 106 resets the total drive time upon receiving the determination result. Furthermore, the replacement detection sensor is included in the aforementioned sensor portion 70.

In this connection, a configuration may also be adopted in which, as usage amount information relating to the usage amount of the above described charging roller 41, the time measuring portion 106 measures the total bias application time that is the total value for the time that a charging bias is applied to the charging roller 41 by the charging bias applying portion 101. In this case, similarly to the case of the above described total drive time, the correction operation portion 103 takes a predetermined time (expressed as "threshold value bias time") corresponding to the above described threshold value time in the total bias application time as a decision boundary for deciding whether the usage amount of the charging roller 41 is a first usage amount or is a second usage amount that is greater than the first usage amount. With respect to the change information in this case, the horizontal axis of the graph shown in the aforementioned FIG. 5 is made to represent the total bias application time (h). Further, the total bias application time is a parameter showing the time that a charging bias was actually applied to the charging roller 41, that is, the time that the charging roller 41 has been actually used, and can thus indicate the usage amount of the charging roller 41 more accurately than the above described total drive time.

The sheet number counting portion 107 counts the number of sheets that are printed. The sheet number counting portion 107 may also count the number of print sheets by counting each time a print operation for one sheet ends, for example, each time a transfer operation at the transferring portion 7 ends. A configuration may also be adopted in which an optical sensor such as a photocoupler or the like is provided in the conveying path 93 or 95, and the counting in question is performed by detecting when a sheet passes the position of this optical sensor. Naturally, a configuration may also be adopted in which passage of a sheet is detected by a mechanical switch. This optical sensor or mechanical switch is included in the aforementioned sensor portion 70.

In this type of configuration, the sheet number counting portion 107 may be configured to count the total number of print sheets as the above described usage amount information relating to the usage amount of the charging roller 41 (the total number of print sheets may be used as usage amount information instead of the above described total drive time or total bias application time). In this case, the total number of print sheets is the overall number of print sheets since use of the current charging roller 41 started. This information of the total number of print sheets is, for example, stored inside the sheet number counting portion 107. In this case also, the correction operation portion 103 takes a predetermined number of sheets (expressed as "threshold value number of sheets") corresponding to the above described threshold value time of the total number of print sheets as a decision boundary for deciding whether the usage amount of the charging roller 41 is a first usage amount or is a second usage amount that is greater than the first usage amount. With respect to the change information in this case, the horizontal axis of the graph shown in the above described FIG. 5 is made to represent the total number of print sheets (sheets). In this connection, similarly to the case described above, when the charging roller 41 or the drum unit is replaced with a new charging roller or drum unit, the sheet number counting portion 107 resets the total number of print sheets to an initial value, for example, zero.

Although in the above described description, examples were given of using the total drive time, the total bias application time, or the total number of print sheets as usage amount information relating to the usage amount of the charging roller 41, the present embodiment is not limited thereto, and various kinds of usage amount information can be employed. In accordance with this, although the printer 1 is described as having a configuration that comprises the time measuring portion 106 and the sheet number counting portion 107, a configuration may also be adopted in which the printer 1 comprises only the time measuring portion 106 or the sheet number counting portion 107.

The correction coefficient "k" that is described above in relation to the first bias correction operation by the correction operation portion 103 will now be described. The value of the correction coefficient k is a numerical value derived, for example, from the following equation (1.1).

$$\Delta V=(\Delta Q*d)/(\epsilon*\epsilon_0*\Delta S) \quad (1.1)$$

Wherein, the symbol "/" represents division (the same applies hereunder).

Further, "ΔV" represents surface potential variation amount, "ΔQ" represents charge variation amount (i.e. ΔQ indicates current amount), "d" represents photosensitive member thickness (film thickness of photosensitive member), "S" represents charge area, "ϵ" represents the dielectric constant of the photosensitive member, and $\epsilon_0$ represents the dielectric constant of a vacuum.

Provided, the above described equation (1.1) is derived from equation (1.3) as a modified equation of equation (1.2) as shown below.

$$Q=C*V=\epsilon*\epsilon_0*(S/d)*V \quad (1.2)$$

$$V=(Q*d)/(\epsilon*\epsilon_0*S) \quad (1.3)$$

In this case, taking the example of a printer with a certain function (for example, a printer that prints 45 sheets per minute machine), for example, when the values ΔQ=1, d=16 μm, S=(220*307) $mm^2$, and each dielectric constant are substituted into the above equation (1.1), ΔV≈2. Provided, for S, the numerical value 220 represents the effective charging width of 220 mm of a charging roller and the numerical value 307 represents the speed of 307 mm/sec (moving distance of the photosensitive member in one second) for the 45 sheets per minute machine in question.

From the relevant substitution result, it is found that the surface potential changes approximately 2 V per 1 μA of current. Accordingly when (Idc(T)−Idc(n))*k of the above described formula (1) is considered, with respect to a 45 sheets per minute machine, if the detected charging current (Idc(n)) is, for example, 75 μA and, for example, it represents a drop of 5 μA in comparison with a target current Idc(T) of 80 μA (Idc(T)−Idc(n)=5 μA), the surface potential of the photosensitive member will decrease by 5*2=10 V, and it is thus necessary to correct this 10 V amount.

In the case of a different, for example, 30 sheet per minute machine for which the linear speed is 178 mm/sec, when the value are substituted in a similar manner into the above equation (1.1), it is found that ΔV≈4, and the surface potential of the photosensitive member drops by 5*4=20 V, and it is thus necessary to correct this 20 V amount. That is, the correction coefficient k is the value ΔV indicated in the above described equation (1.1) (k=ΔV), and that unit is (V/μA) in the present embodiment. Further, k is a value that changes depending on the moving speed (linear speed) of the photosensitive member.

Figure 4:
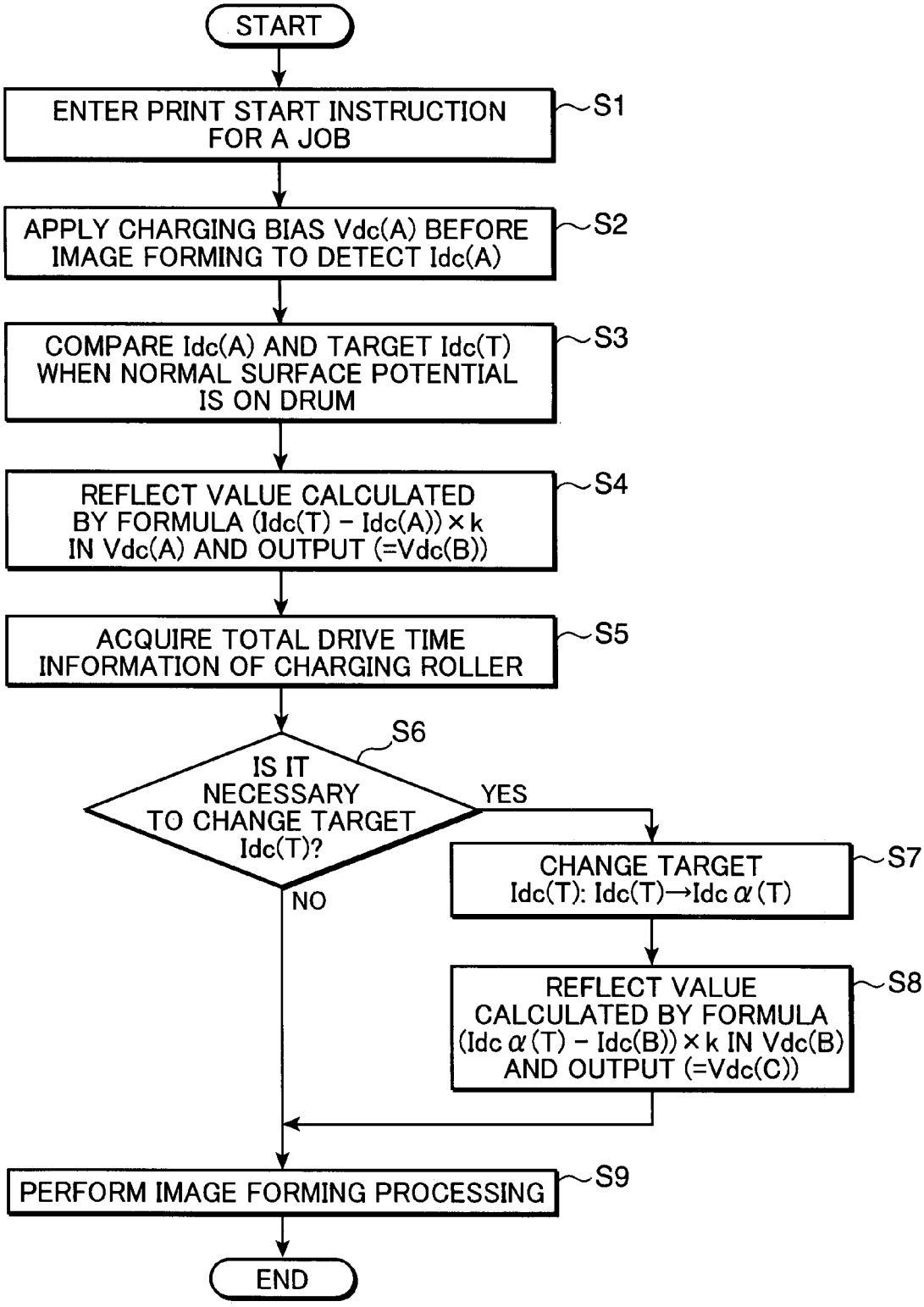
FIG. 4 is a flowchart relating to one example of an operation to correct a charging bias according to the present embodiment.

FIG. 4 is a flowchart relating to one example of an operation to correct a charging bias according to the present embodiment. First, for example, a print start instruction is made for a certain print job by the user inputting an instruction from the operation panel portion 50 or the like (step S1). Before performing the actual image forming operation for this print job, the charging bias applying portion 101 applies a charging bias Vdc(A) to the charging roller 41. Further, the charging current detecting portion 102 detects: a charging current Idc(A) when the charging bias Vdc(A) is applied (step S2). However, this charging bias Vdc (A) is a charging bias as the initial setting value.

Next, the correction operation portion 103 compares the charging current Idc(A) that is detected in the above described step S2 with the target current Idc(T) that is previously stored in the comparison information storing portion 104. More specifically, the correction operation portion 103 subtracts Idc(A) from Idc(T) to determine the difference in these current values (step S3). The correction operation portion 103 then calculates a bias correction value using the formula (Idc(T)−Idc(A))*k (corresponds to the case of n=1 in the above described formula (1)), adds (reflects) this calculated bias correction value to the above described charging bias Vdc(A) to calculate a charging bias Vdc(B), and outputs this charging bias Vdc(B) information to the charging bias applying portion 101 (step S4). According to the present embodiment, this charging bias Vdc(B) is obtained as the result of a first bias correction operation in which a repetition operation is executed only once (only the first repetition operation is performed).

Next, as the second bias correction operation, the correction operation portion 103 first acquires (reads out) information regarding the total drive time of the charging roller 41 from the time measuring portion 106 (step S5) and also reads out change information that is stored in the change information storing portion 105 (conversion characteristics; see FIG. 5). Based on this change information, the correction operation portion 103 determines whether or not the total drive time is greater than or equal to the threshold value time (step S6). When the correction operation portion 103 determines that the total drive time is not greater than or equal to the threshold value time (NO at step S6), the process shifts to the operation of step S9, described later, without changing the target current Idc(T) (without performing any further correction of the charging bias). When the correction operation portion 103 determines that the total drive time is greater than or equal to the threshold value time, i.e. when it determines that it is necessary to change the target current Idc(T) (YES at step S6), the correction operation portion 103 changes (sets) the current target current Idc(T) value to a new target current Idcα(T) that corresponds to the total drive time (step S7). Subsequently, using the target current Idcα(T), the correction operation portion 103 calculates the bias correction value using the above described formula (2) of (Idcα(T)−Idc(B))*k, calculates a new charging bias Vdc(C) by adding this calculated bias correction value to the corrected charging bias obtained as the result of the first bias correction operation, that is, the above described charging bias Vdc(B), and outputs the information of this charging bias Vdc(C) to the charging bias applying portion 101 (step S8). In this case, Idc(B) is, for example, the value detected in step S8 by the charging current detecting portion 102 when the charging bias Vdc(B) is applied to the charging roller 41 by the charging bias applying portion 101.

Thus, bias correction is performed by the first bias correction operation so as to approach a charging bias that is obtained with the target current Idc(T), and bias correction is performed by the second bias correction operation that also takes into account the deterioration of the charging roller to thereby determine the final charging bias value for performing the actual image forming operation. As a result, it is possible to output an appropriate charging bias without the aging time until the image forming operation starts becoming long, even in a case in which the resistance value of the charging roller changes, and an appropriate charging bias can be output that also takes into account the life of the charging roller, i.e. also in the latter half of the life of the charging roller.

Thereafter, image formation processing (print operation) is executed for the print job as instructed in the above described step S1 (step S9). For example, if it is assumed that the print job is a job to print 100 sheets, and the determined charging bias is Vdc(C), the charging bias Vdc(C) is applied to the charging roller 41 for each sheet from 1 to 100, respectively, to perform printing (image formation) in order.

Although according to the present flowchart a configuration is adopted in which the charging bias Vdc(C) that is obtained by the second bias correction operation is used for printing from the first sheet at step S9, a configuration may also be adopted in which the first sheet is printed using the charging bias Vdc(B) that is obtained by the first bias correction operation, and the charging bias Vdc(C) is then reflected in the processing to print the second sheet and thereafter. The important point is that the configuration is one in which the target current Idc(T) is changed in accordance with the charging bias after the first bias correction operation and the corrected charging bias is then further corrected based on the changed target current Idc(T), and an arbitrary method or timing can be employed as the method or timing with which to reflect this further corrected charging bias in the actual printing (image formation processing).

Figure 6:
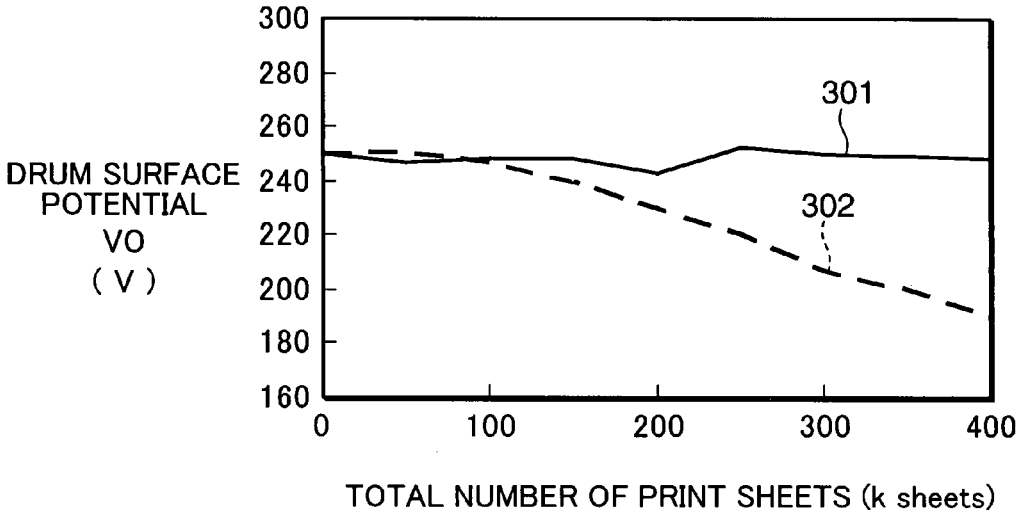
FIG. 6 is a graph diagram showing an example of changes in the surface potential of a photosensitive drum in a case in which charging bias correction is performed and a case in which charging bias correction is not performed.

In this connection, FIG. 6 is a view showing an example of changes in the surface potential of a photosensitive drum in a case in which charging bias correction is performed and a case in which charging bias correction is not performed according to the present embodiment. The vertical axis represents the surface potential VO(V) and the horizontal axis represents the total number of print sheets (unit: 1000 (k) sheets) in an endurance test. A surface potential change characteristic 301 in FIG. 6 illustrates the changes in surface potential in a case in which a second bias correction operation that changes the target current Idc(T) is performed after performing a first bias correction operation by a repetition operation using the above described formula (1) according to the present embodiment. Further, a surface potential change characteristic 302 illustrates the changes in surface potential in a case in which the second bias correction operation is not performed after performing the first bias correction operation, i.e. a case in which the target current Idc(T) value is fixed. According to FIG. 6, it is found that although for the surface potential change characteristic 302 the surface potential VO decreases significantly from around the start of the latter half of the life (endurance life), for the surface potential change characteristic 301 the surface potential is maintained at a substantially fixed level (indicates a favorable surface potential retention properties).

The image forming apparatus (printer 1) according to the present invention as described above comprises a charging bias applying portion 101 (bias applying portion) that applies a charging bias (Vdc) to the charging roller 41, a charging current detecting portion 102 (current detecting portion) that detects a charging current (Idc) when the charging bias is applied, a correction operation portion 103 (bias correcting portion) that performs correction of the charging bias, a comparison information storing portion 104 (target information storing portion) that stores a target charging current value (target current Idc(T)) taken as a target that is a charging current value when the surface of a photosensitive member (photosensitive drum 3) is charged to a required surface potential, and a usage amount information acquiring portion (time measuring portion 106 or sheet number counting portion 107) that acquires usage amount information relating to a usage amount of the charging roller 41, wherein the correction operation portion 103 compares a charging current value (Idc(A)) that is detected by the charging current detecting portion 102 when a predetermined charging bias (charging bias Vdc(A) as an initial setting value) is applied by the charging bias applying portion 101 with a target charging current value that is stored in the comparison information storing portion 104, a first bias correction operation is performed that corrects the above described predetermined charging bias based on the comparison result to obtain a new charging bias (Vdc(B)), and a second bias correction operation is also performed that determines whether the usage amount of the charging roller 41 is a predetermined first usage amount or is a second usage amount that is greater than the first usage amount based on usage amount information that is acquired by the aforementioned usage amount information acquiring portion, and when it is determined that the usage amount is the second usage amount the second bias correction operation changes the target charging current value in accordance with the usage amount of the charging roller and, based on the changed target charging current value, corrects the corrected charging bias (Vdc(B)) that was obtained as a result of the first bias correction operation to obtain a new charging bias (Vdc(C)).

Thus, since a first bias correction operation is performed that obtains a new charging bias by comparing a charging current value when a predetermined charging bias is applied with a target charging current value and then correcting the charging bias on the basis of the comparison result (without continuing execution of a convergence operation until a certain condition that should correct the charging bias is reached), even when the resistance value of the charging roller 41 changes, an appropriate charging bias can be output without the time until the start of an image forming operation becoming long. Further, a second bias correction operation is performed in which the first usage amount is made a usage amount for which there is a normal relationship between a charging current at which a required charging bias can be obtained and a charging bias, and the second usage amount is made a usage amount for which there is an abnormal relationship between the charging current and the charging bias owing to deterioration of the charging roller 41 or the like, it is determined whether the usage amount of the charging roller 41 is the first usage amount or the second usage amount, and when the usage amount is determined to be the second usage amount, the target charging current value is changed in accordance with the usage amount in question and the corrected charging bias is corrected on the basis of the changed target charging current value to obtain a new charging bias. It is therefore possible to output an appropriate charging bias that also takes into consideration the life of the charging roller, that is, in the latter half of the life of the charging roller.

Further, since the target charging current value is changed (changed from a target current Idc(T) to Idcα(T)) by the correction operation portion 103 so as to change in a stepwise manner in accordance with the usage amount of the charging roller, it is easy to perform control (operations) when changing the target charging current value, and thus a second bias correction operation can be performed with good efficiency.

Furthermore, the configuration is one that uses the total drive time that is the sum of the time that the charging roller 41 has been driven is acquired (measured) as usage amount information by the time measuring portion 106 (usage amount information acquiring portion), i.e. the total drive time of the charging roller 41 as usage amount information. It is therefore possible to treat the usage amount information that is used in determining whether the usage amount of the charging roller 41 is the first usage amount or the second usage amount as the simple parameter of total drive time, and the second bias correction operation can thus be carried out with good efficiency.

Further, the configuration is one which uses the total number of print sheets as the sum of the number of sheets that have been printed or the total bias application time as the sum of time that a charging bias is applied by the charging bias applying portion 101 is acquired as usage amount information by the time measuring portion 106 (usage amount information acquiring portion), i.e. the configuration uses the total number of print sheets or the total bias application time as usage amount information. It is therefore possible to treat the usage amount information that is used in determining whether the usage amount of the charging roller 41 is the first usage amount or the second usage amount as the simple parameter of total number of print sheets or total bias application time, and the second bias correction operation can thus be carried out with good efficiency.

Also, since a new charging bias (Vdc(C)) is determined in the second bias correction operation by the correction operation portion 103 by adding the bias correction value that is calculated using the above described formula (2) to the corrected charging bias (Vdc(B)), the second bias correction operation can be performed with good efficiency using a simple operational expression.

Furthermore, since the configuration is such that the usage amount information is reset to a predetermined initial value by the aforementioned usage amount information acquiring portion when it is detected by the replacement detection sensor (or the sensor portion 70) and the control portion 100 (or the correction operation portion 103) (replacement detecting portion) that the charging roller 41 has been replaced with a new charging roller, it is possible to prevent the usage amount information for the old charging roller 41 prior to the replacement being used without change even though the old charging roller 41 is actually replaced with a new charging roller, that is, it is possible to prevent execution of the second bias correction operation on the basis of incorrect usage amount information, and thus the charging bias can be accurately corrected.

Further, since the photosensitive drum 3 consists of an a-Si drum with high durability, it is possible to provide the printer 1 in which, in addition to the performance of bias correction by the first and second bias correction operations, favorable image forming operations (stability) are maintained over a long period.

In this connection, various additions and modifications can be made to the configuration of the present invention as described above without departing from the scope and spirit of the present invention. For example, the following modifications can be made.

(A) Although according to the above described embodiment a configuration is adopted in which usage amount information (total drive time, total bias application time, or total number of print sheets) relating to the usage amount of the charging roller 41 is obtained by detection by the time measuring portion 106 or the sheet number counting portion 107, the present invention is not limited thereto. For example, a configuration may be adopted in which usage amount information is acquired (received) from an external apparatus such as a PC through the network I/F portion 30 or the like.

(B) The printer 1 is not limited to a configuration that performs black and white printing as shown in FIG. 1, and may be configured to perform color printing (color printer).

This application is based on patent application No. 2006-180193 filed in Japan, the contents of which are hereby incorporated by references.

As this invention may be embodied in several forms without departing from the spirit of essential characteristics thereof, the present embodiment is therefore illustrative and not restrictive, since the scope of the invention is defined by the appended claims rather than by the description preceding them, and all changes that fall within metes and bounds of the claims, or equivalence of such metes and bounds are therefore intended to embraced by the claims.

What is claimed is:

1. An image forming apparatus that charges a surface of a photosensitive member to a predetermined potential using a charging roller, comprising:

a bias applying portion that applies a charging bias to the charging roller;

a current detecting portion that detects a charging current when the charging bias is applied;

a bias correcting portion that carries out correction of the charging bias;

a target information storing portion that stores a target charging current value that is taken as a target, that is a charging current value when the surface of the photosensitive member is charged to a required surface potential; and a usage amount information acquiring portion that acquires usage amount information relating to a usage amount of the charging roller; wherein, the bias correcting portion performs a first bias correction operation and a second bias correction operation, in which, the first bias correction operation is an operation that compares a charging current value that is detected by the current detecting portion when a predetermined charging bias is applied by the bias applying portion with a target charging current value that is stored in the target information storing portion, and determines a new charging bias by correcting the predetermined charging bias on the basis of the comparison result, the second bias correction operation is an operation that determines whether a usage amount of the charging roller is a predetermined first usage amount or a second usage amount that is greater than the first usage amount on the basis of usage amount information that is acquired by the usage amount information acquiring portion, and when the usage amount is determined to be the second usage amount, changes the target charging current value in accordance with the usage amount of the charging roller and obtains a new charging bias by correcting the corrected charging bias that is obtained as a result of the first bias correction operation on the basis of the target charging current value that is changed, and the bias correcting portion determines a new charging bias in the second bias correction operation by adding to the corrected charging bias a bias correction value that is calculated using the following formula (a):

$$(Idc\alpha(T)-Idc(m))*k \quad (a)$$

wherein, $Idc\alpha(T)$ represents the target charging current value that is changed, $Idc(m)$ represents a charging current value that is detected by the current detecting portion when the corrected charging bias is applied by the bias applying portion, "k" is a correction coefficient, and the symbol "*" represents multiplication.

2. The image forming apparatus according to claim 1, wherein the bias correcting portion changes the target charging current value in a stepwise manner in accordance with the usage amount of the charging roller.

3. The image forming apparatus according to claim 1, wherein the usage amount information acquiring portion acquires as the usage amount information a total drive time that is a sum of time that the charging roller is driven.

4. The image forming apparatus according to claim 1, wherein the usage amount information acquiring portion acquires as the usage amount information a total number of print sheets that is a sum of sheets that are printed or a total bias application time that is a sum of time that a charging bias is applied by the bias applying portion.

5. The image forming apparatus according to claim 1, further comprising:

a replacement detecting portion that detects that the charging roller is replaced with a new charging roller;

wherein, the usage amount information acquiring portion resets the usage amount information to a predetermined initial value in a case in which the replacement detecting portion detects that the charging roller is replaced with a new charging roller.

6. The image forming apparatus according to claim 1, wherein the photosensitive member comprises amorphous silicon.

* * * * *